US009504134B2

(12) United States Patent
Aliakseyeu et al.

(10) Patent No.: US 9,504,134 B2
(45) Date of Patent: Nov. 22, 2016

(54) METHODS AND APPARATUS FOR CONTROLLING LIGHTING

(71) Applicant: PHILIPS LIGHTING HOLDING B.V., Eindhoven (NL)

(72) Inventors: Dzmitry Viktorovich Aliakseyeu, Eindhoven (NL); Philip Steven Newton, Waalre (NL); Bartel Marinus Van De Sluis, Eindhoven (NL); Tatiana Aleksandrovna Lashina, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/021,525

(22) PCT Filed: Sep. 5, 2014

(86) PCT No.: PCT/IB2014/064269

§ 371 (c)(1),
(2) Date: Mar. 11, 2016

(87) PCT Pub. No.: WO2015/036904

PCT Pub. Date: Mar. 19, 2015

(65) Prior Publication Data

US 2016/0227635 A1 Aug. 4, 2016

Related U.S. Application Data

(60) Provisional application No. 61/878,103, filed on Sep. 16, 2013.

(51) Int. Cl.

| | |
|---|---|
| ***H05B 37/00*** | (2006.01) |
| ***H05B 37/02*** | (2006.01) |
| ***H05B 33/08*** | (2006.01) |

(52) U.S. Cl.
CPC ..... *H05B 37/0272* (2013.01); *H05B 33/0845* (2013.01); *H05B 33/0863* (2013.01)

(58) Field of Classification Search
CPC ..... H05B 33/0863
USPC ..... 315/312, 291
See application file for complete search history.

(56) References Cited

U.S. PATENT DOCUMENTS

| | | | | |
|---|---|---|---|---|
| 6,079,862 | A | 6/2000 | Kawashima et al. | |
| 8,373,366 | B2 * | 2/2013 | Baaijens | H05B 37/029 315/295 |
| 8,723,450 | B2 * | 5/2014 | Hatley | H05B 33/086 315/312 |

(Continued)

FOREIGN PATENT DOCUMENTS

| | | | |
|---|---|---|---|
| EP | 2391189 | A2 | 11/2011 |
| WO | 2008001259 | A2 | 1/2008 |

(Continued)

*Primary Examiner* — Thuy Vinh Tran
(74) *Attorney, Agent, or Firm* — Meenakshy Chakravorty

(57) ABSTRACT

Disclosed are methods and apparatus for lighting control. One or more properties of light output are controlled based on a light origination input and a light destination input received via one or more user interfaces. For example, in some embodiments a light origination input and a light destination input may be utilized to determine one or more control parameters of one or more LEDs to achieve illumination of a light destination area indicated by the light destination input, wherein the illumination is from a light origination area indicated by the light origination input.

18 Claims, 5 Drawing Sheets

(56) References Cited

U.S. PATENT DOCUMENTS

| | | | | |
|---|---|---|---|---|
| 8,853,971 | B2 * | 10/2014 | Bennette | H05B 33/0863 315/185 S |
| 2006/0002110 | A1 | 1/2006 | Dowling et al. | |
| 2010/0213876 | A1 * | 8/2010 | Adamson | H05B 37/0272 315/312 |
| 2010/0296285 | A1 | 11/2010 | Chemel et al. | |
| 2014/0354160 | A1 * | 12/2014 | Aggarwal | H05B 37/0227 315/152 |
| 2016/0007423 | A1 * | 1/2016 | Aliakseyeu | H05B 33/0845 315/292 |

FOREIGN PATENT DOCUMENTS

| | | | |
|---|---|---|---|
| WO | 2008139360 | A1 | 11/2008 |
| WO | 2012131544 | A1 | 10/2012 |

* cited by examiner

METHODS AND APPARATUS FOR CONTROLLING LIGHTING

CROSS-REFERENCE TO PRIOR APPLICATIONS

This application is the U.S. National Phase application under 35 U.S.C. §371 of International Application No. PCT/IB2014/064269, filed on Sep. 5, 2014, which claims the benefit of U.S. Provisional Patent Application No. 61/878,103, filed on Sep. 16, 2013. These applications are hereby incorporated by reference herein.

TECHNICAL FIELD

The present invention is directed generally to lighting control. More particularly, various inventive methods and apparatus disclosed herein relate to controlling one or more properties of light output based on a light origination input and light destination input.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications.

In lighting systems, such as those that include LED-based light sources, it is desirable to have efficient control over one or more light sources of the lighting system. For example, it may be desirable to control which of a plurality of the light sources are illuminated and/or to control one or more lighting parameters of one or more of the light sources. For example, it may be desirable to control color, color temperature, intensity, beam width, beam direction, illumination intensity, and/or other parameters of one or more of the light sources.

Direct specification during configuration of the one or more light sources enables specification of lighting parameters. However, direct specification may suffer from one or more drawbacks such as lack of ability to fine-tune applied lighting, lack of flexibility for adapting to newly-introduced environmental objects and/or relocation of existing objects, and/or lack of tailoring of lighting parameters and/or adjustments to specific objects. Control switches connected to a mains power supply also enable control of one or more light sources. However, such control switches may suffer from one or more drawbacks such as requiring connection to the mains power supply, which may pose constraints on where the control switches may be installed. Additionally and/or alternative drawbacks of direct specification, control switches, and/or other techniques may be presented.

Thus, there is a need in the art to provide methods and apparatus that enable control of one or more properties of light output and that optionally overcome one or more drawbacks of existing methods and/or apparatus.

SUMMARY

The present disclosure is directed to lighting control. More particularly, various inventive methods and apparatus disclosed herein relate to controlling one or more properties of light output based on a light origination input and a light destination input received via one or more user interfaces. For example, in some embodiments, a light origination input and a light destination input may be utilized to determine one or more control parameters of one or more LEDs to achieve illumination of a light destination area indicated by the light destination input, wherein the illumination is from a light origination area indicated by the light origination input. Thus, apparatus and methods described herein may be utilized to achieve a light effect at a light destination area, wherein the light effect originates from a desired direction.

Generally, in one aspect, the invention relates to a method of controlling one or more properties of light output from LEDs that includes the steps of: receiving a light origination input via a first user interface segment, the light origination input indicative of a light origination area; identifying, based on the light origination input, one or more LEDs in the light origination area; receiving a light destination input via a second user interface segment, the light destination input indicative of a light destination area; determining, based on the light destination input, one or more control parameters related to the identified one or more LEDs in the light origination area, wherein the control parameters are determined to achieve illumination of the light destination area from the light origination area; and implementing the one or more control parameters.

In some embodiments, the first user interface segment is on a first surface and the second user interface segment is on a second surface unique from the first surface. In some versions of those embodiments, the first user interface segment is on a first side of a mobile computing device and the second user interface segment is on a second side of the mobile computing device.

In some embodiments, the first user interface segment is on a first surface and the second user interface segment is on a unique portion of the first surface.

In some embodiments, the first user interface segment is on a structure supporting the one or more LEDs.

In some embodiments, the step of receiving the light origination input includes receiving data indicative of at least one of the LEDs in the light origination area being at least partially covered.

In some embodiments, the step of implementing the one or more control parameters includes determining which of the one or more LEDs in the light origination area to activate.

In some embodiments, the method further includes the step of establishing a connection with a mobile computing device, and the light origination input and the light destination input are received via the connection with the mobile computing device. In some versions of those embodiments, the method further includes the step of providing information related to a plurality of potential light origination inputs to the mobile computing device, the potential light origination inputs including the received light origination input.

In some embodiments, the method further includes the steps of: receiving a light destination input refinement via the second user interface segment, the light destination input refinement indicative of at least one of modifying the light destination area and modifying the illumination applied to the light destination area; determining, based on the light destination input refinement, one or more refined control parameters related to the identified one or more LEDs in the light origination area; and implementing the one or more refined control parameters. In some versions of those embodiments, the light destination input refinement is indicative of modifying the light destination area to a modified area and the one or more refined control parameters are determined to achieve illumination of the modified area from the light origination area. In some versions of those embodiments, the light destination input refinement is indicative of modifying the illumination applied to the light destination area by at least one of altering the color, altering the color temperature, and altering the brightness of the illumination; and the one or more refined control parameters are determined to achieve the at least one of altering the color, altering the color temperature, and altering the brightness of the illumination.

In some embodiments, the light origination input is received prior to the light destination input, and the method further includes the step of providing a visual indication of potential light destination areas prior to receiving the light destination input. In some versions of those embodiments, the step of providing the visual indication of potential light destination areas prior to receiving the light destination input includes providing the visual indication on the second user interface element. In some versions of those embodiments, the step of providing the visual indication of potential light destination areas prior to receiving the light destination input includes providing a plurality of spatially distinguishable light outputs; and receiving the light destination input includes receiving a selection of one or more of the light outputs.

In some embodiments, the light destination input is received prior to the light origination input and the method further includes the step of providing a visual indication of potential light origination areas prior to receiving the light origination input.

Generally, in another aspect, the invention relates to a lighting apparatus that includes a memory and a controller operable to execute instructions stored in the memory. The instructions include instructions to: receive a light origination input via a first user interface segment, the light origination input indicative of a light origination area; identify, based on the light origination input, one or more LEDs in the light origination area; receive a light destination input via a second user interface segment, the light destination input indicative of a light destination area; determine, based on the light destination input, one or more control parameters related to the identified one or more LEDs in the light origination area, wherein the control parameters are determined to achieve illumination of the light destination area from the light origination area; and implement the one or more control parameters.

Generally, in another aspect, the invention relates to a lighting system that includes: a plurality of LEDs; and at least one controller in electrical communication with the LEDs. The at least one controller receives a light origination input via a first user interface segment, the light origination input indicative of a light origination area; identifies, based on the light origination input, one or more LEDs in the light origination area; receives a light destination input via a second user interface segment, the light destination input indicative of a light destination area; determines, based on the light destination input, one or more control parameters related to the identified one or more LEDs in the light origination area, wherein the control parameters are determined to achieve illumination of the light destination area from the light origination area; and implements the one or more control parameters.

Other embodiments may include a non-transitory computer readable storage medium storing instructions executable by a processor to perform a method such as one or more of the methods described herein. Yet other embodiments may include a system including memory and one or more processors operable to execute instructions, stored in the memory, to perform a method such as one or more of the methods described herein.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (described further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as described above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs).

The term "light source" should be understood to refer to any one or more of a variety of radiation sources, including, but not limited to, LED-based sources (including one or more LEDs as defined above.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as described above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions described herein. A "processor" is one example of a controller which employs one or more microprocessors that may be programmed using software (e.g., microcode) to perform various functions described herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions described herein. Various storage media may be fixed within a processor or controller or may be transportable, such that the one or more programs stored thereon can be loaded into a processor or controller so as to implement various aspects of the present invention described herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," described further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as described herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts described in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
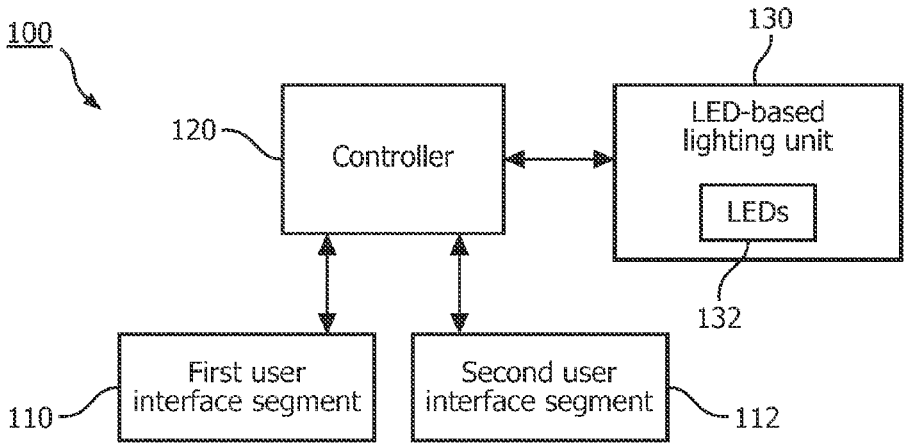
FIG. 1 illustrates a block diagram of an embodiment of a LED-based lighting system having a controller, a LED-based lighting unit, a first user interface segment, and a second user interface segment.

In a lighting system such as one that includes LED-based light sources, it is desirable to have control over one or more light sources of the lighting system. For example, it may be desirable to control color, color temperature, intensity, beam width, beam direction, illumination intensity, and/or other parameters of one or more of the light sources. Direct specification during configuration of the one or more light sources and/or control switches connected to a mains power supply may each enable specification of one or more lighting parameters. However, direct specification may suffer from one or more drawbacks such as lack of ability to fine-tune applied lighting, lack of flexibility, and/or lack of tailoring of lighting parameters. Also, control switches may suffer from one or more drawbacks such as requiring connection to the mains power supply.

Thus, Applicants have recognized and appreciated that it would be beneficial to provide various inventive methods and apparatus related to controlling one or more properties of light output based on a light origination input and light destination input and that optionally overcome one or more drawbacks of existing methods and/or apparatus.

More generally, Applicants have recognized and appreciated that it would be beneficial to provide various inventive methods and apparatus that enable user-friendly and efficient control of one or more properties of light output.

In view of the foregoing, various embodiments and implementations of the present invention are directed to lighting control.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, aspects of the methods and apparatus disclosed herein are described in conjunction with a lighting system having only LED-based light sources. However, one or more aspects of the methods and apparatus described herein may be implemented in other lighting systems that additionally and/or alternatively include other non-LED light sources. Implementation of the one or more aspects described herein in alternatively configured environments is contemplated without deviating from the scope or spirit of the claimed invention. Also, for example aspects of the methods and apparatus disclosed herein are described in conjunction with a single controller and single lighting unit. However, one or more aspects of the methods and apparatus described herein may be implemented in other lighting systems that may include multiple controllers and/or multiple lighting units.

FIG. 1 illustrates a block diagram of an embodiment of a LED-based lighting system 100. The lighting system 100 includes a controller 120 controlling one or more light output properties of at least one LED-based lighting unit 130. The LED-based lighting unit 130 includes one or more LEDs 132 that are configured to generate light output. As described herein, the lighting controller 120 controls the LEDs 132 and/or one or more optical elements associated with the LEDs 132 based at least in part on input received via a first user interface segment 110 and a second user interface segment 112. For example, the lighting controller 120 may receive a light origination input from the first user interface segment 110 and a light destination input from the second user interface segment 112, and determine control parameters of the LED-based lighting unit 130 based on the light origination input and the light destination input. The light origination input may be indicative of a light origination area. In other words, the light origination input may be indicative of a desired area of LED-based lighting unit 130 from which light should originate. For example, the light origination input may be indicative of a subset of LEDs 132 of the LED-based lighting unit 130 which should generate light. The light destination input may be indicative of a light destination area. In other words, the light destination input may be indicative of a desired area of a structure (e.g., a shelf, a floor, a wall) to which light originating from LED-based lighting unit 130 should be directed.

In some embodiments, the LEDs 132 of the LED-based lighting unit 130 are driven by one or more drivers and the controller 120 communicates with the one or more drivers to control one or more light output properties of the LEDs 132 based on the control parameters. For example, the controller 120 may control which of the LEDs 132 are generating light output, the intensity of generated light output, etc. In some embodiments the controller 120 may form part of the driver for the LED-based lighting unit 130. In some embodiments the controller 120 communicates with one or more local controllers of the LED-based lighting unit 130 to control the LEDs 132. For example, a plurality of local controllers may be provided, each controlling one or more LEDs 132 of the LED-based lighting unit 130. In some embodiments, the controller 120 itself may include a plurality of local controllers, each controlling one or more LEDs 132 of the LED-based lighting unit 130. The controller 120 may control a single group of LEDs 132 of the LED-based lighting unit 130 or may control multiple groups of LEDs 132. Embodiments including multiple controllers may optionally incorporate wired and/or wireless communication between the multiple controllers. In some embodiments optical elements associated with LEDs 132 of the LED-based lighting unit 130 are controlled by one or more drivers, actuation structures, and/or other structures, and the controller 120 communicates with one or more of such structures to control one or more aspects of the optical elements based on the control parameters. For example, the controller 120 may control: whether one or more of the optical elements are active with respect to one or more respective of the LEDs 132, light output diversion properties of one or more of the optical elements, light output collimating properties of one or more of the optical elements, etc.

The controller 120 may include and/or be coupled to at least one communication interface to enable the controller 120 to be in communication with one or more other components such as the LED-based lighting unit 130, the first user interface segment 110, and/or the second user interface segment 112. Communication between the lighting controller 120 and one or more components may occur through, for example, near-field communication, Bluetooth, Wi-Fi, and/or other communication protocols.

The controller 120 may include and/or access a storage subsystem containing programming and data constructs that provide the functionality of some or all of the modules described herein. For example, the storage subsystem may include the logic to determine lighting control parameters for the LED-based lighting unit 130 based on input received from the first user interface segment 110 and the second user interface segment 112 and/or implement the lighting control parameters in response to the received inputs. The modules implementing the functionality of certain embodiments are generally executed by the controller 120 alone or in combination with other controllers (e.g., distributed processing). Memory may be used in a storage subsystem of the lighting controller 120 and may be accessed by the lighting controller 120 and controller 114. Memory can include a number of memories including a main random access memory (RAM) for storage of instructions and data during program execution and a read only memory (ROM) in which fixed instructions are stored. A file storage subsystem can provide persistent storage for program and data files, and may include a hard disk drive, a floppy disk drive along with associated removable media, a CD-ROM drive, an optical drive, or removable media cartridges.

In some embodiments, the LED-based lighting unit 130 may include a plurality of LED groupings each including one or more of the LEDs 132. For example, in some embodiments the LED groupings may each include at least one surface of LEDs 132 and/or one or more portions of a surface of LEDs 132. A surface of LEDs 132 may include a flat surface, an arcuate surface, a multi-faceted surface, and/or other surface that includes one or more LEDs 132. Some examples of a surface that may include one or more LEDs include a wall, a ceiling, a column (e.g., a round column, a square column, and elliptical column), a shelf (e.g., a retail shelf) or other surface). One or more aspects of the control of each of the LED groupings may optionally be specific to the individual LED grouping. For example, the intensity, color, beam width, and/or beam direction of one or more LED groupings may be individually controlled. For example, a beam direction of light output of one or more LED groupings may be redirected to focus the light output on a desired destination area for the light output.

As described in additional detail herein, in some implementations, the first user interface segment 110 and/or the second user interface segment 112 may be implemented with the LED-based lighting unit 130. For example, the LED-based lighting unit 130 may include one or more sensors that may be responsive to user-initiated contact with the LED-based lighting unit 130 and may provide output to the controller 120 that is indicative of such contact and/or of a location of such contact. In some embodiments the one or more sensors responsive to contact may include one or more sensors of a touch-sensitive sheet of the LED-based lighting unit 130. For example, a translucent touch-sensitive sheet may be overlaid over LEDs 132 of the LED-based lighting unit 130 and/or a touch-sensitive sheet may be provided on a housing of the LED-based lighting unit 130. For example, the LEDs 132 may be provided on the bottom of a retail shelf and the touch-sensitive sheet may be attached to a top of the retail shelf opposite of the LEDs 132. In some embodiments the one or more sensors responsive to user-initiated contact may include one or more of the LEDs 132 of the LED-based lighting unit 130 that may be configured to sense light incident thereon. For example, the LEDs 132 may sense ambient light thereon and may be responsive to an object being placed thereover and/or nearby, as such placement may cause the amount of sensed ambient light to decrease. The amount of sensed ambient light may be provided to the controller 120 to enable the controller to determine that a user has placed an object over and/or adjacent to such LED. Objects that may be placed over and/or adjacent to LEDs 132 include, for example a user's finger(s), a retail product for display, a sticker that may be affixed over LEDs 132, etc. In some embodiments the LEDs configured to sense light may also be configured to generate light output. For example, the LEDs may generate light output in a first mode and be capable of sensing light when they are not in the first mode.

Also, as described in additional detail herein, in some implementations the first user interface segment 110 and/or the second user interface segment 112 may be implemented with a light destination structure to which light output from the LED-based lighting unit 130 may be directed. For example, the light destination structure may include one or more sensors that may be responsive to user-initiated contact and may provide output to the controller 120 that is indicative of such contact and/or of a location of such contact. In some embodiments the one or more sensors may be responsive to a touch by a user and may include one or more sensors of a touch-sensitive sheet provided on the light destination structure. For example, a translucent touch-sensitive sheet may be implemented with a retail shelf to which light output is directed. In some embodiments the one or more sensors responsive to a user-initiated contact may include one or more LEDs of a light destination structure that may be configured to sense light incident thereon.

Also, as described in additional detail herein, in some implementations the first user interface segment 110 and/or the second user interface segment 112 may be implemented with one or more touch-sensitive surfaces of a mobile computing device. For example, a front face of a mobile computing device may be touch-sensitive and may be the first user interface segment 110 and a back face of the device may also be touch-sensitive and be the second user interface segment 112. Also, for example, only a front of the device may be touch-sensitive and may be the first user interface segment 110 and/or the second user interface segment 112.

Figures 3A, 3B, 3C:
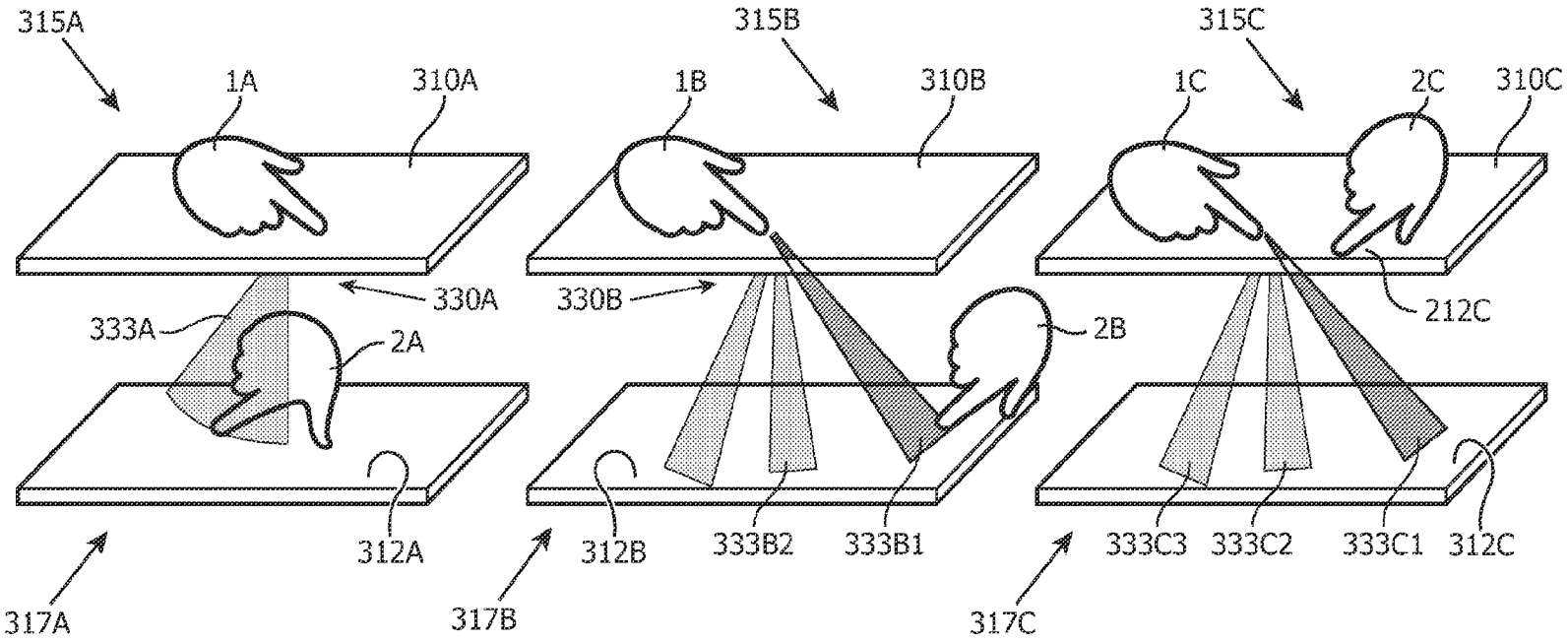
FIG. 3A illustrates an example of a user interaction with a first user interface segment of a contact-sensitive light emitting structure and a user interaction with a second user interface segment of a contact-sensitive light destination structure to achieve desired illumination of an area of the contact-sensitive light destination structure.
FIG. 3B illustrates another example of a user interaction with a first user interface segment of a contact-sensitive light emitting structure and a user interaction with a second user interface segment of a contact-sensitive light destination structure to achieve desired illumination of an area of the contact-sensitive light destination structure.
FIG. 3C illustrates an example of a user interaction with a first user interface segment of a contact-sensitive light emitting structure and with a second user interface segment of the contact-sensitive light emitting structure to achieve desired illumination of an area of a destination structure.

FIG. 3A illustrates an example of a user interaction with a first user interface segment 310A of a light emitting structure 315A and a user interaction with a second user interface segment 312A of a light destination structure 317A to achieve desired illumination of an area of the touch-sensitive light destination structure 317A. The light emitting structure 315A incorporates the user interface segment 310A on a top surface thereof and includes a LED-based lighting unit 330A on a bottom surface thereof. The LED-based lighting unit 330A includes one or more LEDs that, when providing light output, each direct provided light output toward one or more portions of the light destination structure 317A. In some embodiments the light emitting structure 315A may be a retail shelf and the light destination structure 317A may also be a retail shelf. In some embodiments the light destination structure 317A may be a retail shelf and the light emitting structure 315A may be a structure disposed above the retail shelf.

The user interface segment 310A and the user interface segment 312A are both contact-sensitive interface segments. For example, the user interface segment 310A and/or the user interface segment 312A may be a touch-sensitive sheet utilizing resistive and/or capacitive techniques to enable determination of presence and/or location of one or more touches by a user. Also, for example, the user interface segment 310A and/or the user interface segment 312A may be a surface of LEDs that may be utilized in some embodiments to sense a user-initiated contact with the surface of LEDs as described, for example, with respect to FIG. 4.

With a pointer finger of a first hand 1A, the user touches a particular area of the user interface segment 310A, which provides a light origination input to a controller associated with the LED-based lighting unit 330A. The light origination input is indicative of a desired light origination area from which the indicated light output 333A should originate. The controller may utilize the received light origination input to identify one or more LEDs of the LED-based lighting unit 330A that are in the light origination area. For example, the light origination input may be indicative of one or more locations of the user interface segment 310A touched by the user and the controller may access a mapping of locations of the user interface segment 310A to LEDs of the LED-based lighting unit 330A to determine one or more LEDs that correspond to the one or more locations of the user interface segment 310A.

Although a user touch of the interface segment 310A with a pointer finger of the first hand 1A is illustrated, other touches may be utilized to define a light origination area. For example, a user may trace a circle, square, or other shape with the user's finger and such input may be utilized to determine a light origination area that substantially corresponds to the traced shape. Also, for example, the user may touch the user interface segment 310A with two or more fingers simultaneously and the locations of the two or more touches may be utilized to define a light origination area that substantially corresponds to the bounds of the location of the two or more touches. Moreover, as described herein, in some embodiments a user may place an object on the user interface segment 310A to define a light origination area. For example a user may place a sticker and/or other object on the interface segment 310A and a light origination input may be provided to the controller that is indicative of the presence and/or location of such an object. One of ordinary skill in the art, having had the benefit of the present disclosure, will recognize and appreciate that additional and/or alternative user-initiated contacts may be utilized to define a light origination area.

With a pointer finger and a thumb of a second hand 2A, the user touches a particular area of the user interface segment 312A, which provides a light destination input to the controller associated with the LED-based lighting unit 330A. The light destination input is indicative of a desired light destination area of the light destination structure 317A to which the light output 333A should be directed. In the illustrated embodiment of FIG. 3A, the spacing between the finger and the thumb of the second hand 2A is indicative of a desired width of the light destination area. The controller may utilize the light destination input and the light origination input to determine one or more control parameters of the one or more LEDs in the light origination area to effectuate illumination of the light destination area from the light origination area. For example, the light destination input may be indicative of one or more locations of the user interface segment 312A touched by the user and the controller may access a mapping of locations of the user interface segment 312A to LEDs of the LED-based lighting unit 330A to determine one or more LEDs that correspond to the light origination area and that may provide a light output to the light destination area. For example, the controller may determine that of the LEDs that correspond to the light origination area indicated by the first hand 1A, one of those LEDs provides light output directed toward the light destination area indicated by the second hand 2A. Based on such a determination, the controller may determine control parameters that cause the one LED to generate light output and that cause any other LEDs to not generate light output. As a result, light output 333A may be generated that originates from the light origination area and that is directed to the light destination area. In some embodiments the controller may additionally and/or alternatively determine control parameters that cause an optical element associated with one or more LEDs to be activated, actuated, and/or otherwise altered to direct light output from one or more LEDs associated with the light origination area to the light destination area.

In some embodiments, a controller will only alter light output properties based on a user interaction with the first interface element 310A and the second interface element 312A when the interactions occur with a threshold time period of one another. For example, in some embodiments the controller will only alter light output properties based on a user interaction with the first interface element 310A and the second interface element 312A when the interactions occur simultaneously. Also, for example, in some embodiments the controller will only alter light output properties based on a user interaction with the first interface element 310A and the second interface element 312A when the interactions occur with X seconds of one another.

Although a user touch of the interface segment 312A with a pointer finger and a thumb of the second hand 2A is illustrated, other touches may be utilized to define a light destination area. For example, a user may trace a circle, square, or other shape with the user's finger and such input may be utilized to determine a light destination area that substantially corresponds to the traced shape. Also, for example, the user may touch the interface segment 312A with a single finger and the location of the touch may be utilized to define a light destination area that substantially corresponds to the location of the touch. Moreover, as described herein, in some embodiments a user may place an object on the user interface segment 312A to define a light destination area. For example a user may place a sticker and/or other object on the interface segment 312A and a light destination input may be provided to the controller that is indicative of the presence and/or location of such an object. One of ordinary skill in the art, having had the benefit of the present disclosure, will recognize and appreciate that additionally and/or alternative user-initiated contacts may be utilized to define a light destination area.

In some embodiments, further input may be provided via first interface segment 310A and/or second interface segment 312A to refine the provided light output 333A. For example, in some embodiments a pinch close gesture may be utilized on the second interface segment 312A to narrow the size of the destination area (thereby narrowing the width of the light output 333A incident on the light destination structure 317A) or a pinch open gesture may be utilized on the second interface segment 312A to broaden the size of the destination area (thereby broadening the width of the light output 333A incident on the light destination structure 317A). The controller may receive such refinements and determine refined control parameters to achieve illumination of the refined destination area from the light origination area (e.g., by activating and/or deactivating certain LEDs of the light origination area). Also, for example, in some embodiments a new light origination area may be defined by a further touch of the user on the second interface segment 312A such as a single tap, a double tap, a long press, and/or other gesture.

FIG. 3B illustrates another example of a user interaction with a first user interface segment 310B of a light emitting structure 315B and a user interaction with a second user interface segment 312B of a light destination structure 317B to achieve desired illumination of an area of the light destination structure 317B via light output 333B1. Like FIG. 3A, the light emitting structure 315B incorporates the user interface segment 310B on a top surface thereof and includes a LED-based lighting unit 330B on a bottom surface thereof. The LED-based lighting unit 330B includes one or more LEDs that, when providing light output, each direct provided light output toward one or more portions of the light destination structure 317B. In some embodiments the light emitting structure 315B may be a retail shelf and the light destination structure 317B may also be a retail shelf. In some embodiments the light destination structure 317B may be a retail shelf and the light emitting structure 315A may be a structure disposed above the retail shelf. The user interface segment 310B and the user interface segment 312B are both touch-sensitive interface segments.

With a pointer finger of a first hand 1B, the user touches a particular area of the user interface segment 310B, which provides a light origination input to a controller associated with the LED-based lighting unit 330B. The light origination input is indicative of a desired light origination area from which light output should originate. The controller utilizes the light origination input to identify one or more LEDs of the LED-based lighting unit 330B that are in the light origination area. For example, the light origination input may be indicative of one or more locations of the user interface segment 310B touched by the user and the controller may access a mapping of locations of the user interface segment 310B to LEDs of the LED-based lighting unit 330B to determine one or more LEDs that correspond to the one or more locations of the user interface segment 310B. The controller then causes the LEDs in the light origination area to be illuminated to provide a visual indication of the areas to which light output may be provided from the light origination area. In particular, the controller causes the LEDs in the light origination area to be illuminated to provide light outputs 333B1, 333B2, and 333B3, each of which provides a visual indication of an area to which light output may be provided. Providing the visual indication of areas to which light output may be provided may enable a user to identify those areas of the second interface element 312B that may be selected as valid light destination locations.

With a pointer finger of a second hand 2B, the user touches a particular area of the user interface segment 312B, which provides a light destination input to a controller associated with the LED-based lighting unit 330B. The light destination input is indicative of a desired light destination area of the light destination structure 317B to which light output should be directed. The provided light outputs 333B1, 333B2, and 333B3 assist the user in identifying the three valid light destination areas from which to select for the selected light origination area. As illustrated by the bold outline of light output 333B1, in FIG. 3B the user has selected a light destination area corresponding to the light output 333B1. The controller may utilize the light destination input and the light origination input to determine one or more control parameters of the one or more LEDs in the light origination area to maintain the light output 333B1 and remove the light outputs 333B2 and 333B3. For example, the light destination input may be indicative of one or more locations of the user interface segment 312B touched by the user and the controller may access a mapping of locations of the user interface segment 312B to LEDs of the LED-based lighting unit 330B to determine one or more LEDs that correspond to the light origination area and that may provide light output 333B1 to the light destination area. For example, the controller may determine that of the LEDs that correspond to the light origination area indicated by the first hand 1B, one of those LEDs provides light output directed toward the light destination area indicated by the second hand 2B. Based on such a determination, the controller may determine control parameters that cause the one LED to generate light output and that cause any other LEDs to not generate light output. In some embodiments the controller may additionally and/or alternatively determine control parameters that cause an optical element associated with one or more LEDs to be activated, actuated, and/or otherwise altered to direct light output from one or more LEDs associated with the light origination area to the light destination area.

In some embodiments, the user may select additional light destination areas corresponding to the light outputs 333B2 and/or 333B3 and light output from the light origination area may also be provided to the selected additional light destination areas. For example, if the user selects a light destination area corresponding to the light output 333B2 within a threshold period of time of selection of the light destination area corresponding to the light output 333B1, the controller may utilize the additional light destination input to determine one or more control parameters of the one or more LEDs in the light origination area to also maintain the light output 333B2. In some embodiments, instead of directly selecting one or more desired destination areas, a user may provide a light destination input indicative of a desired light destination area by selecting one or more light destination areas the user wishes to eliminate. For example, in some embodiments, to maintain light output 333B1 the user may select light destination areas corresponding to the light outputs 333B2 and 333B3. In some of those embodiments selection of the light destination area corresponding to light output 333B2 would eliminate the light output 333B2 and selection of the light destination area corresponding to light output 333B3 would eliminate the light output 333B3, thereby leaving light output 333B1 and inferentially selecting the light destination area corresponding to light output 333B1.

In some embodiments, a controller will only alter light output properties based on a user interaction with the first interface element 310B and the second interface element 312B when the interactions occur with a threshold time period of one another. Although certain user touches of the interface segments 310B and 312B are illustrated, other touches and/or object placements may be utilized to define a light origination area and/or a light destination area. In some embodiments further input may be provided via first interface segment 310B and/or second interface segment 312B to refine the provided light output 333B1. For example, as described, in some embodiments further input may be provided to additionally provide light output 333B2 and/or 333B3. The controller may receive such refinements and determine refined control parameters to achieve illumination of the refined destination area from the light origination area (e.g., by activating and/or deactivating certain LEDs of the light origination area).

FIG. 3C illustrates an example of a user interaction with a first user interface segment 310C of a light emitting structure 315C and with a second user interface segment 312C of the light emitting structure 315C to achieve desired illumination of an area of a destination structure 317C. Like FIGS. 3A and 3B, the light emitting structure 315C incorporates the first user interface segment 310C on a top surface thereof and includes a LED-based lighting unit 330C on a bottom surface thereof. The light emitting structure 315C also incorporates the second user interface segment 312C on a top surface thereof. The LED-based lighting unit 330C includes one or more LEDs that, when providing light output, each direct provided light output toward one or more portions of the light destination structure 317C. In some embodiments the light emitting structure 315C may be a retail shelf and the light destination structure 317C may also be a retail shelf. In some embodiments the light destination structure 317C may be a retail shelf and the light emitting structure 315C may be a structure disposed above the retail shelf.

The user interface segment 310C and the user interface segment 312C are both touch-sensitive interface segments. In some embodiments, the first user interface segment 310C and the second user interface segment 312C may be two different portions of the same cohesively formed interface. For example, the first user interface segment 310C may be a first portion of a touch-sensitive sheet and the second user interface segment 312C may be a second portion of the touch-sensitive sheet. In some implementations the first user interface segment 310C and the second user interface segment 312C may be segments that are dynamically defined. For example, the first user interface segment 310C may be a portion that is initially interacted with by a user and the second user interface segment 312C may be another portion that is subsequently interacted with by a user (optionally while maintaining contact with the first user interface segment 310C).

With a pointer finger of a first hand 1C, the user touches a particular area of the user interface segment 310C, which provides a light origination input to a controller associated with the LED-based lighting unit 330C. The light origination input is indicative of a desired light origination area from which light output should originate. The controller utilizes the light origination input to identify one or more LEDs of the LED-based lighting unit 330C that are in the light origination area. For example, the light origination input may be indicative of one or more locations of the user interface segment 310C touched by the user and the controller may access a mapping of locations of the user interface segment 310C to LEDs of the LED-based lighting unit 330C to identify one or more LEDs that correspond to the one or more locations of the user interface segment 310C. The controller then causes the LEDs in the light origination area to be illuminated to provide a visual indication of the areas to which light output may be provided from the light origination area. In particular, the controller causes the LEDs in the light origination area to be illuminated to provide light outputs 333C1, 333C2, and 333C3, each of which provides a visual indication of an area to which light output may be provided. Providing the visual indication of areas to which light output may be provided may enable a user to identify those areas of the light destination structure 317C that may be selected as a valid light destination location.

With a pointer finger of a second hand 2C, the user interfaces with the user interface segment 312C to provide a light destination input to a controller associated with the LED-based lighting unit 330C. For example, the user may use a swiping action, a tapping action, and/or other gesture to select one or more of the light outputs 333C1, 333C2, and 333C3, thereby providing a light destination input to the controller that is indicative of a desired light destination area of the light destination structure 317C to which light output should be directed. For example, swipe gestures of the user with the second hand 2C may cycle through each of the light outputs 333C1-C3 (e.g., each swipe will cause a new one of the light outputs to be provided). When one of the light outputs 333C1-C3 is being provided, the user may pause for a predetermined period of time to select the one light output and/or perform a gesture (e.g., tap, double tap) to select the one light output, thereby providing a light destination input by selecting a light destination area that corresponds to the one light output. As illustrated by the bold outline of light output 333C1 in FIG. 3C, the user has selected a light destination area corresponding to the light output 333C1. The controller may utilize the light destination input and the light origination input to determine one or more control parameters of the one or more LEDs in the light origination area to maintain the light output 333C1 and remove the light outputs 333C2 and 333C3. For example, the light destination input may be indicative of a desire for the light output 333C1 and the controller may access a mapping of the light output 333C1 to LEDs of the LED-based lighting unit 330C to determine one or more LEDs that correspond to the light origination area and that provide light output 333C1 to the light destination area. Based on such a determination, the controller may determine control parameters that cause the one LED to generate light output and that cause any other LEDs to not generate light output.

In some embodiments, the user may select additional light destination areas corresponding to the light outputs 333C2 and/or 333C3 and light output from the light origination area may also be provided to the selected additional light destination areas. In some embodiments, a controller will only alter light output properties based on a user interaction with the first interface element 310C and the second interface element 312C when the interactions occur with a threshold time period of one another. Although certain user touches of the interface segments 310C and 312C are illustrated, other touches and/or object placements may be utilized to define a light origination area and/or a light destination area. In some embodiments further input may be provided via first interface segment 310C and/or second interface segment 312C to refine the provided light output 333C1. For example, in some embodiments further input may be provided to additionally provide light output 333C2 and/or 333C3. The controller may receive such refinements and determine refined control parameters to achieve illumination of the refined destination area from the light origination area (e.g., by activating and/or deactivating certain LEDs of the light origination area).

FIGS. 3B and 3C illustrate embodiments of utilizing a light origination input to cause the LEDs in the light origination area to be illuminated to provide a visual indication of multiple destination areas to which light output may be provided from the light origination area. In some embodiments, a light destination input may be utilized to cause LEDs from multiple light origination areas to be illuminated to provide a visual indication of the multiple light origination areas from which light may be provided to the destination area. For example, with reference to FIG. 3C, in some embodiments a user may touch a particular area of the user interface segment 312B, which provides a light destination input to a controller associated with the LED-based lighting unit 330B. The light destination input is indicative of a desired light destination area to which light output should be provided. The controller utilizes the light destination input to identify one or more LEDs of the LED-based lighting unit 330B that provide light output to the light destination area. For example, the light destination input may be indicative of one or more locations of the user interface segment 312B touched by the user and the controller may access a mapping of locations of the user interface segment 312B to LEDs of the LED-based lighting unit 330B to determine one or more LEDs that provide light output to the one or more locations of the user interface segment 312B. The controller then causes those LEDs to be illuminated to provide a visual indication of the LEDs from which light output may be provided to the light destination area. The user may then select a light origination area based on those illuminated LEDs. Providing the visual indication of areas from which light output may be generated may enable a user to identify those areas of the first user interface segment 310B that may be selected as valid light origination locations. In some embodiments, in addition to and/or as an alternative to illuminating LEDs to provide a visual indication of areas from which light output may be generated, the first user interface segment 310B may include dynamic display properties to provide an indication of those areas of the first user interface segment 310B that may be selectable. For example, the user interface segment 310B may be a touch-sensitive display screen and may highlight in a different color those areas of the first user interface segment 310 that may be selectable.

Figure 4:
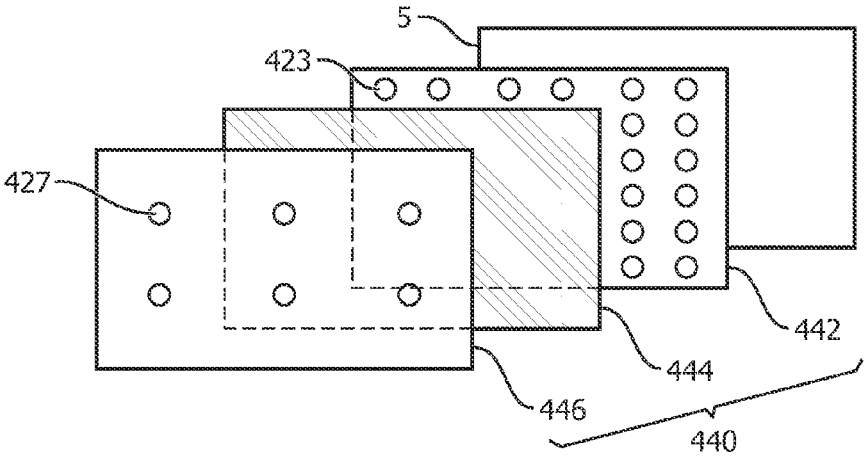
FIG. 4 illustrates an exploded perspective view of a portion of a surface of LEDs that may be utilized in some embodiments to sense a user-initiated contact with the surface of LEDs.

FIG. 4 illustrates an exploded perspective view of a portion of a surface of LEDs that may be utilized in some embodiments to sense a user-initiated contact with the surface of LEDs. For example, the surface of LEDs may be utilized as one or both of the first interface segment 310A and second interface segment 312A of FIG. 3A. Also, for example, in some embodiments the surface of LEDs may include one or more of the same LEDs that provide illumination to a light destination area. For example, in some embodiments user interface 310A may be provided on the same side of the light emitting structure 315A as the LED-based lighting unit 330A and may be optionally incorporated in the LED-based lighting unit 330A.

In FIG. 4 the multiple layers of a surface of LEDs 440 are illustrated exploded away from one another and from an attachment surface 5 (e.g., a retail shelf). The surface of LEDs 440 includes a first LED layer 442, a diffuse layer 444, and a second LED layer 446. The surface of LEDs 440 may be coupled to the surface 5. For example, in some embodiments the first LED layer 442 may be adhesively attached to the surface 5. In some other embodiments the first LED layer 442 may be cohesively formed with the surface 5. The first LED layer 442 includes a plurality of LEDs 423. In some embodiments the spacing and/or power of the LEDs 423 may be such that a substantially homogenous light emitting surface may be created when the diffuse layer 444 is atop the first LED layer 442. In some embodiments the diffuse layer 444 may include a plastic with microstructures that diffuse light output generated by LEDs 423. The diffuse layer 444 may include electrical connections and/or throughways to enable electrical connection of the second LED layer 446.

The second LED layer 446 includes a plurality of LEDs 427. As illustrated, in some embodiments the LEDs 427 may be less densely populated than the LEDs 423.

The LEDs 423 and/or 427 may be utilized as sensing LEDs to identify presence of a user's finger and/or other object. For example, in some embodiments one or more of the LEDs 423 may provide light output and the LEDs 427 may operate in a sensing mode to sense light output received at the LEDs 427. Light output from LEDs 423 that is received at one of the LEDs 427 may indicate an object is present atop the LED 427 and causing some of the light output from the LEDs 423 to be reflected and/or refracted back toward that LED 427. For example, placement of an object atop the LEDs 427 may cause at least some of the light output from the LEDs 423 that is incident on the object to be reflected back toward the LEDs 427. In some embodiments at least a portion of an object that faces the surface of LEDs may be reflective to assist in redirecting light back toward the LEDs 427. In some embodiments a sensed light value at one or more LEDs 427 may be compared to a baseline light value indicative of anticipated light values when no object is present atop or adjacent the respective LEDs 427. In some embodiments the light generated by the LEDs 423 may be coded light to distinguish such light from other light such as ambient light.

Figure 5A:
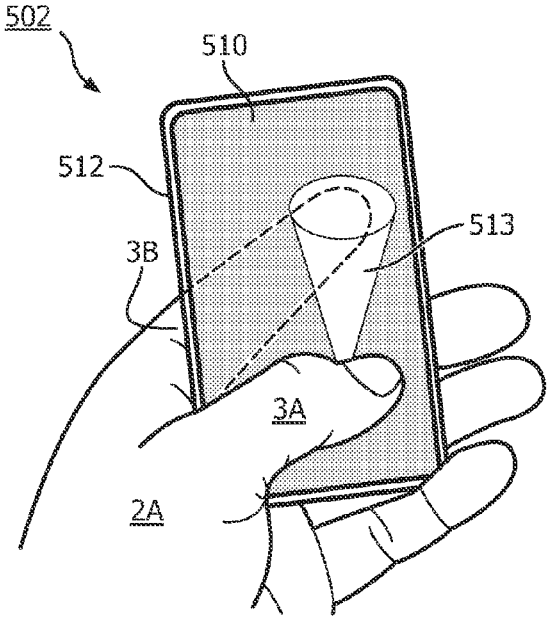
FIGS. 5A and 5B illustrate an example of a user interaction with a first user interface segment on a first side of a mobile computing device and a user interaction with a second user interface segment on a second side of the mobile computing device to achieve desired illumination of an area of a destination structure.
Figure 5B:
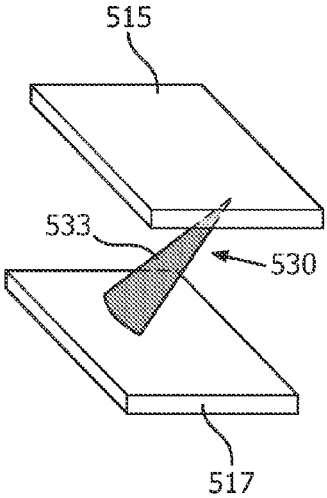

FIGS. 5A and 5B illustrate an example of a user interaction with a first user interface segment 510 on a first side of a mobile computing device 502 and a user interaction with a second user interface segment 512 on a second side of the mobile computing device 502 to achieve desired illumination of an area of a light destination structure 517 from a light emitting structure 515. The light emitting structure 515 includes a LED-based lighting unit 530 on a bottom surface thereof. The LED-based lighting unit 530 includes one or more LEDs that, when providing light output, each direct provided light output toward one or more portions of the light destination structure 517. In some embodiments the light emitting structure 515 may be a ceiling and the light destination structure 517 may be a floor. In some embodiments the light destination structure 517 may be a retail shelf and the light emitting structure 515 may be a retail shelf or a structure disposed above the retail shelf.

The user interface segment 510 and the user interface segment 512 are both contact-sensitive interface segments. For example, the user interface segment 510 may be a touch-sensitive screen on the front of the mobile computing device 502 such as a touch-sensitive display screen. Also, for example, the user interface segment 512 may also be a touch-sensitive screen that is on the rear of the mobile computing device 502 such as a touch-sensitive display screen and/or a touch-sensitive cover that is on the rear of the mobile computing device 502 but that does not provide an active display.

With a thumb 3A of a hand 2A, the user touches a particular area of the user interface segment 510, which provides a light origination input to a controller associated with the LED-based lighting unit 530. The mobile computing device 502 and the controller associated with the LED-based lighting unit 530 may be in network communication with one another via Bluetooth, Wi-Fi, and/or other communications techniques. The light origination input is indicative of a desired light origination area from which the indicated light output 533 should originate. The controller may utilize the received light origination input to identify one or more LEDs of the LED-based lighting unit 530 that are in the light origination area. For example, the light origination input may be indicative of one or more locations of the user interface segment 510 touched by the user and the controller may access a mapping of locations of the user interface segment 510 to LEDs of the LED-based lighting unit 530 to determine one or more LEDs that correspond to the one or more locations of the user interface segment 510. For example, a scaled mapping between the light emitting structure 515 and the user interface segment 510 may be provided. For example, the entire bottom surface of the light emitting structure 515 may be provided with LEDs and a center of the user interface segment 510 may correspond to the center of the light emitting structure 515 and a corner of the user interface segment 510 may correspond to a respective corner of the light emitting structure 515.

Although a user touch of the interface segment 510 with a thumb 3A of the first hand 2A is illustrated, other touches may be utilized to define a light origination area. For example, a user may trace a circle, square, or other shape with the user's finger and such input may be utilized to determine a light origination area that substantially corresponds to the traced shape. One of ordinary skill in the art, having had the benefit of the present disclosure, will recognize and appreciate that additional and/or alternative user-initiated contacts may be utilized to define a light origination area.

With a pointer finger 3B of the hand 2A, the user touches a particular area of the user interface segment 512, which provides a light destination input to a controller associated with the LED-based lighting unit 530. The pointer finger 3B is shown in broken lines in FIG. 5A where it extends behind the mobile computing device 502. The light destination input is indicative of a desired light destination area of the light destination structure 517 to which the light output 533 should be directed. In the illustrated embodiment of FIG. 5B, a visual indication 513 of the light output 533 is provided on the user interface segment 510 to provide visual feedback to the user. The visual indication 513 extends between the thumb 3A and the location of the pointer finger 3B and its tapered nature indicates the thumb 3A sets the origin of the light output 533 and the pointer finger 3B sets the destination. The controller may utilize the light destination input and the light origination input to determine one or more control parameters of the one or more LEDs in the light origination area to effectuate illumination of the light destination area from the light origination area. For example, the light destination input may be indicative of one or more locations of the user interface segment 512 touched by the user and the controller may access a mapping of locations of the user interface segment 512 to LEDs of the LED-based lighting unit 530 to determine one or more LEDs that correspond to the light origination area and that may provide a light output to the light destination area. Based on such a determination, the controller may determine control parameters that cause the one LED to generate light output and that cause any other LEDs to not generate light output. As a result, light output 533 may be generated that originates from the light origination area and that is directed to the light destination area. In some embodiments the controller may additionally and/or alternatively determine control parameters that cause an optical element associated with one or more LEDs to be activated, actuated, and/or otherwise altered to direct light output from one or more LEDs associated with the light origination area to the light destination area.

Figure 6A:
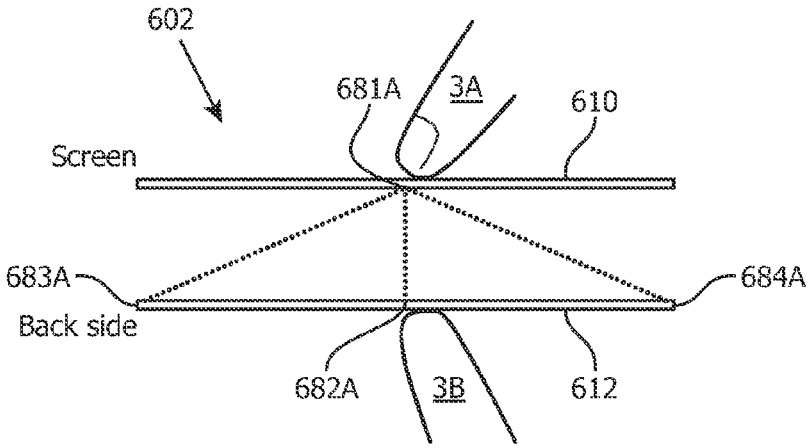
FIGS. 6A and 6B illustrate another example of a user interaction with a first user interface segment on a first side of a mobile computing device and a user interaction with a second user interface segment on a second side of the mobile computing device to achieve desired illumination of an area of a destination structure.
Figure 6B:
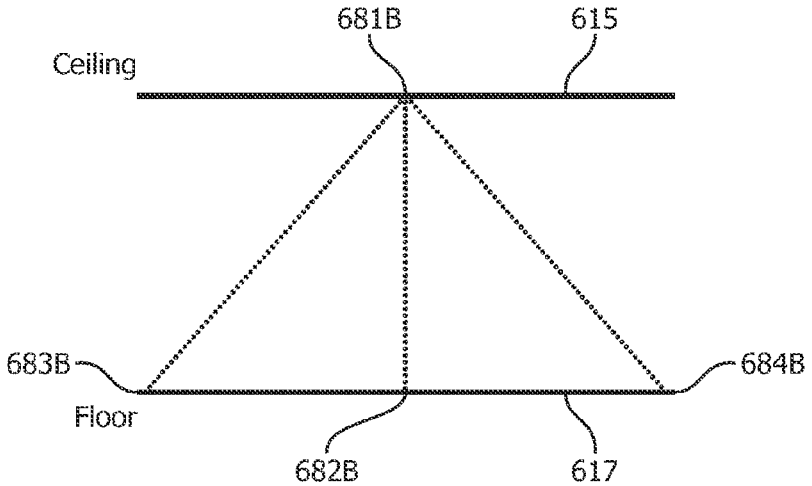

FIGS. 6A and 6B illustrate another example of a user interaction with a first user interface segment 610 on a first side of a mobile computing device 602 and a user interaction with a second user interface segment 612 on a second side of the mobile computing 602 device to achieve desired illumination of an area of a light destination structure 617 from a light emitting structure 615. The light emitting structure 615 is a ceiling and the light destination structure 617 is a floor. The light emitting structure 615 may include a LED-based lighting unit on a bottom surface thereof that provides light output toward one or more portions of the light destination structure 617. The user interface segment 610 and the user interface segment 612 are both contact-sensitive interface segments. For example, the user interface segment 610 may be a touch-sensitive screen on the front of the mobile computing device 602 and the user interface segment 612 may be a touch-sensitive cover that is on the rear of the mobile computing device 602.

In FIG. 6A, a first finger 3A is illustrated touching an area 681A of the user interface segment 610, which is mapped to a light origination area 681B on the ceiling 615 (FIG. 6B). In FIG. 6A, a second finger 3B is illustrated touching an area 682A of the user interface segment 612, which is mapped to an area 682B on the floor 617 (FIG. 6B). Thus, the interaction illustrated in FIG. 6A may cause a light output in FIG. 6B that originates from the light origination area 681B and is directed downward toward the area 682B. In FIG. 6B, the extents 683B and 684B represent the maximum points at which light from light origination area 681B may be directed. In other words, light from light origination area 681B may not be directed beyond extents 683B and 684B.

In some embodiments, extents 683A and 684A of the user interface segment 612 may be mapped to respective of extents 683B and 684B. Thus, contacting extent 683A with second finger 3B while maintaining first finger 3A at area 681A will cause light output from light origination area 681B to be directed at an angle toward extent 683B. Also, contacting midway between extent 683A and area 682A will cause light output from light origination area 681B to be directed at an angle midway between area 682B and extent 683B. Similar extents may be defined in other dimensions not illustrated in FIGS. 6A and 6B. In some other embodiments multiple slide gestures or other gestures toward extent 683A may be required to provide a destination input that is indicative of extent 683B. For example, a first slide gesture by finger 3B from area 682A toward extent 683A may change the light destination area to a point between area 682B and extent 683B (e.g., half way, a third of the way). A subsequent slide gesture toward extent 683A (e.g., from area 682A) may change the light destination area to a point that is farther from the area 682B and closer to the extent 683B (e.g., all the way to extent 683B, two thirds of the way). One of ordinary skill in the art, having had the benefit of the present disclosure, will recognize and appreciate that additionally and/or alternative user-initiated contacts may be utilized to define a light origination area and/or a light destination area.

Figure 7:
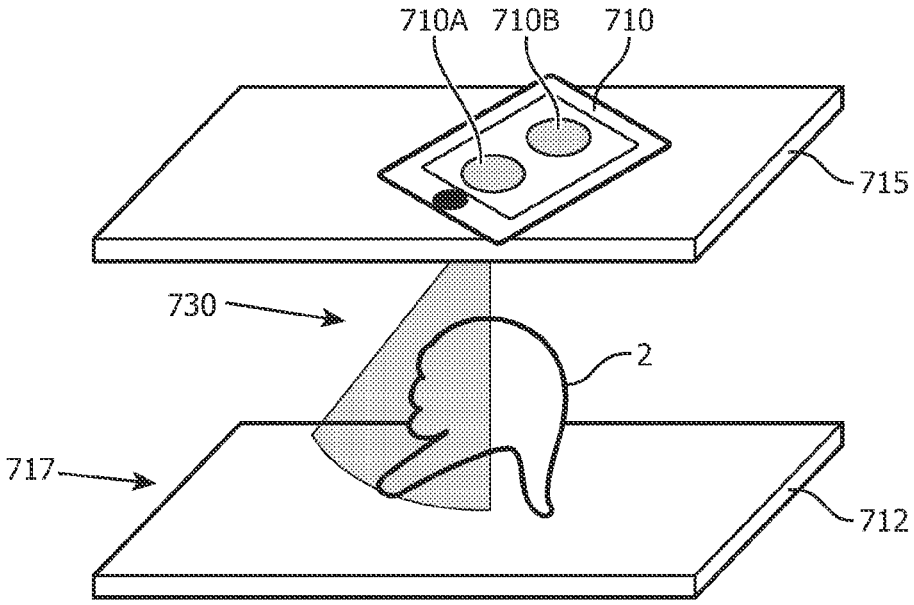
FIG. 7 illustrates an example of a user interaction with a first user interface segment on a first side of a mobile computing device and a user interaction with a second user interface segment on a destination structure to achieve desired illumination of an area of the destination structure.

FIG. 7 illustrates an example of a user interaction with a first user interface segment 710 on a first side of a mobile computing device 702 and a user interaction with a second user interface segment 712 on a destination structure 717 to achieve desired illumination 733 of an area of the destination structure 717 via a LED-based lighting unit 730 of a destination structure 715. With a pointer finger of a hand 2, the user interfaces with the user interface segment 712 to provide a light destination input to a controller associated with the LED-based lighting unit 730. For example, the user may use one or more interactions, such as those described with respect to FIGS. 3A-C, to provide a light destination input to the controller that is indicative of a desired light destination area of the light destination structure 717 to which light output should be directed.

The touch-sensitive display screen of the mobile computing device 702 is utilized as the first user interface segment 710. In some embodiments the first user interface segment 710 may be utilized in a similar manner as described with respect to FIGS. 5A and 6A. In some embodiments the first user interface segment 710 may provide more detailed information about particular light sources that may be selected as the light output origination. For example, the mobile computing device 702 may be in network communication with a controller of the LED-based lighting unit 730 (e.g., via Wi-Fi or NFC) and may receive information related to particular LEDs that may be selected as the light output origination. For example, as illustrated in FIG. 7, graphical illustrations of LEDS 710A and 710B may be provided that correspond to LEDs of the LED-based lighting unit 730. The user may select, via user interface segment 710, one or both of the graphical illustrations of LEDS 710A and 710B to activate and/or deactivate the respective LEDs of the LED-based lighting unit 730. In some embodiments the user may also be presented, via user interface segment 710, with additional lighting effect parameters for selection, and select one or more of the additional lighting effects for implementation. For example, the user may presented with color options via user interface segment 710 and select a desired color of the light output 733 via the user interface segment 710. In some embodiments the user may also be presented, via user interface segment 710, with different gestures that may be utilized (via user interface segment 710 and/or 712) to define the light output 733. For example, the user interface segment 710 may inform the user that double tapping of the user interface segment 712 at a desired destination area may enable cycling between various available colors of light output.

Figure 2:
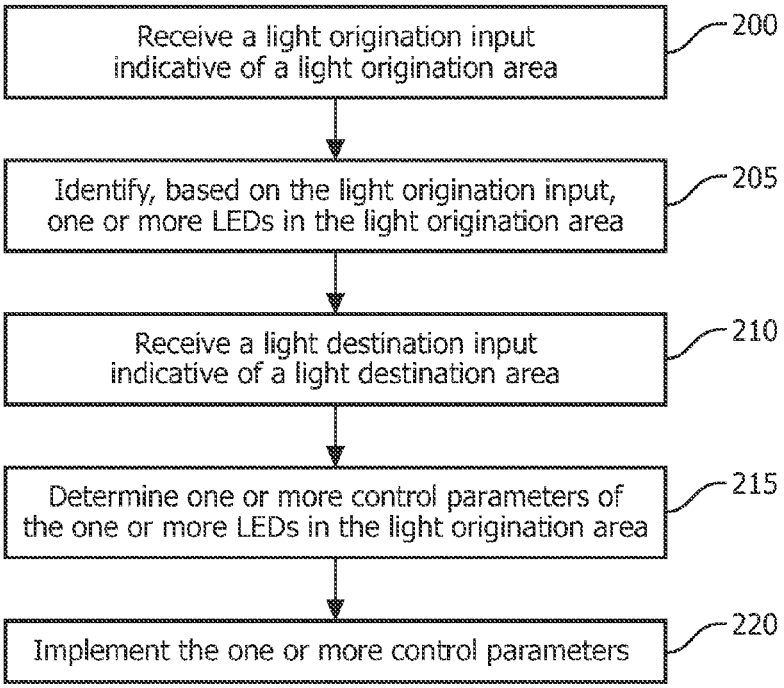
FIG. 2 illustrates a flow chart of an example method of utilizing a light origination input and a light destination input to control one or more LEDs.

Referring to FIG. 2, a flow chart of an example method of utilizing a light origination input and a light destination input to control one or more LEDs illustrated. Other implementations may perform the steps in a different order, omit certain steps, and/or perform different and/or additional steps than those illustrated in FIG. 2. For convenience, aspects of FIG. 2 will be described with reference to one or more components of a lighting system that may perform the method. The components may include, for example, one or more of the components of lighting system 100 of FIG. 1 and/or one or more components of FIGS. 3A-3C and/or 5-7. Accordingly, for convenience, aspects of FIGS. 1, 3A-3C, and/or 5-7 may be described in conjunction with FIG. 2.

At step 200, a light origination input is received that is indicative of a light origination area. For example, with reference to FIG. 1, the first user interface segment 110 may be in communication with controller 120 and controller 120 may receive an input from the first user interface segment 110 that is indicative of a light origination area. For example, the first user interface segment 110 may be all or a portion of a touch-sensitive device and may provide input to the controller 120 that is indicative of an area of the touch-sensitive device that was touched by a user and/or upon which an object was placed by the user.

At step 205, one or more LEDs in the light origination area are identified based on the light origination input. For example, with reference to FIG. 1, a mapping of the user interface segment 110 to LEDs 132 of the LED-based lighting unit 130 may be provided and one or more LEDs 132 identified that correspond to the light origination input received at step 200.

At step 210, a light destination input is received that is indicative of a light destination area. For example, with reference to FIG. 1, the second user interface segment 112 may be in communication with controller 120 and controller 120 may receive an input from the second user interface segment 112 that is indicative of a light destination area. For example, the second user interface segment 112 may be all or a portion of a touch-sensitive device and may provide input to the controller 120 that is indicative of an area of the touch-sensitive device that was touched by a user and/or upon which an object was placed by the user.

At step 215, one or more control parameters of the one or more LEDs in the light origination area are determined. The control parameters are determined to achieve illumination of the light destination area indicated by the input at step 210, wherein the illumination is achieved from one or more of the LEDs identified at step 205 that are in the light origination area. For example, with reference to FIG. 1, the controller 120 may access a mapping to determine one or more LEDs identified at step 205 that provide light output to the light destination area indicated by the input received at step 210. For example, the controller may determine that of the LEDs identified at step 205, one of those LEDs provides light output directed toward the light destination area indicated at step 210. Based on such a determination, the controller may determine control parameters that cause the one LED to generate light output and that cause any other LEDs to not generate light output. In some embodiments the controller may additionally and/or alternatively determine control parameters that cause an optical element associated with one or more LEDs to be activated, actuated, and/or otherwise altered to direct light output from one or more LEDs associated with the light origination area to the light destination area.

At step 220, the one or more control parameters determined at step 215 are implemented. For example, with reference to FIG. 1, one or more LEDs 132 may either be switched on or off to achieve illumination of the light destination area indicated by the input at step 210, wherein the illumination is achieved from one or more of the LEDs identified at step 205 that are in the light origination area. One or more controllers and/or drivers in communication with the controlled LEDs may effectuate the adjustment to the controlled LEDs. In some embodiments the implementation of the control parameters may cause an optical element associated with one or more LEDs to be activated, actuated, and/or otherwise altered to direct light output from one or more LEDs associated with the light origination area to the light destination area.

Figure 8:
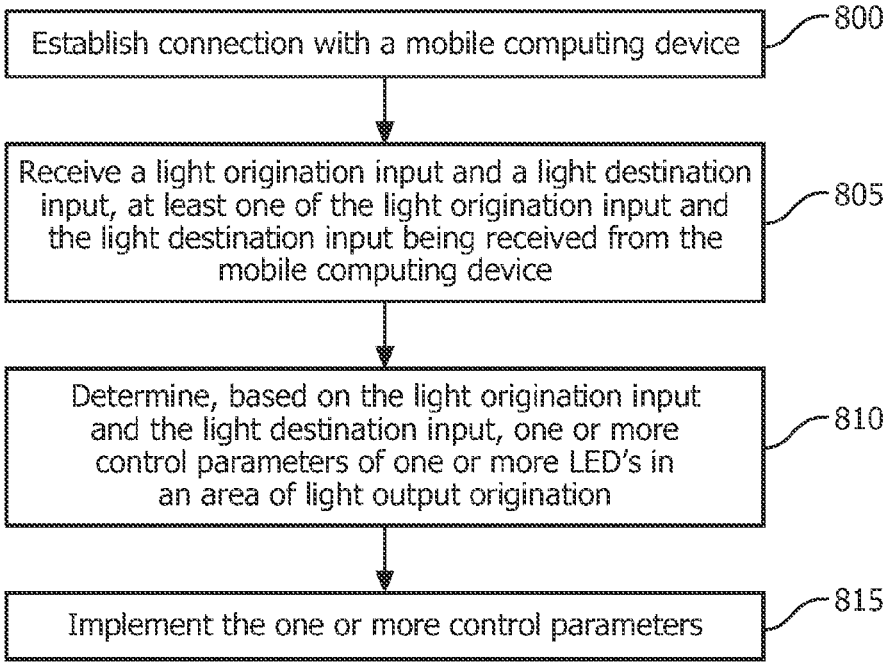
FIG. 8 illustrates a flow chart of another example method of utilizing a light origination input and a light destination input to control one or more LEDs.

FIG. 8 illustrates a flow chart of another example method of utilizing a light origination input and a light destination input to control one or more LEDs. Other implementations may perform the steps in a different order, omit certain steps, and/or perform different and/or additional steps than those illustrated in FIG. 8. For convenience, aspects of FIG. 8 will be described with reference to one or more components of a lighting system that may perform the method. The components may include, for example, one or more of the components of lighting system 100 of FIG. 1 and/or one or more components of FIGS. 5-7. Accordingly, for convenience, aspects of FIGS. 1 and/or 5-7 will be described in conjunction with FIG. 8.

At step 800 a connection is established with a mobile computing device. For example, with reference to FIGS. 5A and 5B, a connection may be established between the mobile computing device 502 and a controller associated with the LED-based lighting unit 530.

At step 805 a light origination input and a light target input are received. At least one of the light origination input and the light destination input is received from the mobile computing device. For example, with reference to FIG. 5A, the light origination input may be received via user interaction with the user interface segment 510 (of mobile computing device 502) and the light destination input may be received via user interaction with the user interface segment 512 (of mobile computing device 502). Also, for example, with reference to FIG. 6A, the light origination input may be received via user interaction with the user interface segment 610 (of mobile computing device 602) and the light destination input may be received via user interaction with the user interface segment 612 (of mobile computing device 602). Also, for example, with reference to FIG. 7A, the light origination input may be received via user interaction with the user interface segment 710 (of mobile computing device 702) and the light destination input may be received via user interaction with the user interface segment 712.

At step 810, one or more control parameters of one or more LEDs in a light origination area are determined based on the light origination input and the light target input. The control parameters are determined to achieve illumination of the light destination area indicated by the input at step 805, wherein the illumination is achieved from the light origination area indicated by the input at step 810.

For example, with reference to FIGS. 5A and 5B, a controller may utilize the light destination input and the light origination input to determine one or more control parameters of the one or more LEDs in the light origination area to effectuate illumination of the light destination area from the light origination area. For example, the light destination input may be indicative of one or more locations of the user interface segment 512 touched by the user and the controller may access a mapping of locations of the user interface segment 512 to LEDs of the LED-based lighting unit 530 to determine one or more LEDs that correspond to the light origination area and that may provide a light output to the light destination area. Based on such a determination, the controller may determine control parameters that cause the one or more LEDs to generate light output and that cause any other LEDs to not generate light output. As a result, light output 533 may be generated that originates from the light origination area and that is directed to the light destination area. In some embodiments the controller may additionally and/or alternatively determine control parameters that cause an optical element associated with one or more LEDs to be activated, actuated, and/or otherwise altered to direct light output from one or more LEDs associated with the light origination area to the light destination area.

At step 815, the one or more control parameters determined at step 810 are implemented. For example, with reference to FIGS. 5A and 5B, one or more LEDs may either be switched on or off to achieve illumination of the light destination area indicated by the input at step 805, wherein the illumination is achieved from one or more of LEDs that are in the light origination area indicated by the input at step 805. One or more controllers and/or drivers in communication with the controlled LEDs may effectuate the adjustment to the controlled LEDs. In some embodiments the implementation of the control parameters may cause an optical element associated with one or more LEDs to be activated, actuated, and/or otherwise altered to direct light output from one or more LEDs associated with the light origination area to the light destination area.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing between parentheses in the claims, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method of controlling one or more properties of light output from LEDs, comprising:

receiving a light origination input via a first user interface segment, the light origination input indicative of a light origination area;

identifying, based on the light origination input, one or more LEDs in the light origination area;

receiving a light destination input via a second user interface segment, the light destination input indicative of a light destination area;

determining, based on the light destination input, one or more control parameters related to the identified one or more LEDs in the light origination area, wherein the control parameters are determined to achieve illumination of the light destination area from the light origination area; and implementing the one or more control parameters.

2. The method of claim 1, wherein the first user interface segment is on a first surface and the second user interface segment is on a second surface unique from the first surface.

3. The method of claim 2, wherein the first user interface segment is on a first side of a mobile computing device and the second user interface segment is on a second side of the mobile computing device.

4. The method of claim 1, wherein the first user interface segment is on a first surface and the second user interface segment is on a unique portion of the first surface.

5. The method of claim 1, wherein the first user interface segment is on a structure supporting the one or more LEDs.

6. The method of claim 1, wherein receiving the light origination input includes:

receiving data indicative of at least one of the LEDs in the light origination area being at least partially covered.

7. The method of claim 1, wherein implementing the one or more control parameters includes:

determining which of the one or more LEDs in the light origination area to activate.

8. The method of claim 1, further comprising:

establishing a connection with a mobile computing device and wherein the light origination input and the light destination input are received via the connection with the mobile computing device.

9. The method of claim 8, further comprising:

providing information related to a plurality of potential light origination inputs to the mobile computing device, the potential light origination inputs including the received light origination input.

10. The method of claim 1, further comprising:

receiving a light destination input refinement via the second user interface segment, the light destination input refinement indicative of at least one of modifying the light destination area and modifying the illumination applied to the light destination area;

determining, based on the light destination input refinement, one or more refined control parameters related to the identified one or more LEDs in the light origination area; and implementing the one or more refined control parameters.

11. The method of claim 10, wherein the light destination input refinement is indicative of modifying the light destination area to a modified area and wherein the one or more refined control parameters are determined to achieve illumination of the modified area from the light origination area.

12. The method of claim 10, wherein the light destination input refinement is indicative of modifying the illumination applied to the light destination area by at least one of altering the color, altering the color temperature, and altering the brightness of the illumination and wherein the one or more refined control parameters are determined to achieve the at least one of altering the color, altering the color temperature, and altering the brightness of the illumination.

13. The method of claim 1, wherein the light origination input is received prior to the light destination input and further comprising:

providing a visual indication of potential light destination areas prior to receiving the light destination input.

14. The method of claim 13, wherein providing the visual indication of potential light destination areas prior to receiving the light destination input includes providing the visual indication on the second user interface element.

15. The method of claim 13, wherein providing the visual indication of potential light destination areas prior to receiving the light destination input includes providing a plurality of spatially distinguishable light outputs and wherein receiving the light destination input includes receiving a selection of one or more of the light outputs.

16. The method of claim 1, wherein the light destination input is received prior to the light origination input and further comprising:

providing a visual indication of potential light origination areas prior to receiving the light origination input.

17. A lighting apparatus including a memory and a controller operable to execute instructions stored in the memory, comprising instructions to:

receive a light origination input via a first user interface segment, the light origination input indicative of a light origination area;

identify, based on the light origination input, one or more LEDs in the light origination area;

receive a light destination input via a second user interface segment, the light destination input indicative of a light destination area;

determine, based on the light destination input, one or more control parameters related to the identified one or more LEDs in the light origination area, wherein the control parameters are determined to achieve illumination of the light destination area from the light origination area; and implement the one or more control parameters.

18. A lighting system comprising:

a plurality of LEDs; and at least one controller in electrical communication with the LEDs;

wherein the at least one controller:

receives a light origination input via a first user interface segment, the light origination input indicative of a light origination area;

identifies, based on the light origination input, one or more LEDs in the light origination area;

receives a light destination input via a second user interface segment, the light destination input indicative of a light destination area;

determines, based on the light destination input, one or more control parameters related to the identified one or more LEDs in the light origination area, wherein the control parameters are determined to achieve illumination of the light destination area from the light origination area; and implements the one or more control parameters.

* * * * *